United States Patent [19]

Gloersen

[11] 4,078,964

[45] * Mar. 14, 1978

[54] METHOD AND APPARATUS FOR FILLING A PRESSURE TREATMENT VESSEL WITH A FIBER MATERIAL AND LIQUID MIXTURE

[76] Inventor: Stig Torleif Gloersen, P1 45012, 655 90 Karlstad, Sweden

[ * ] Notice: The portion of the term of this patent subsequent to Jul. 5, 1994, has been disclaimed.

[21] Appl. No.: 584,902

[22] Filed: Jun. 9, 1975

[30] Foreign Application Priority Data

Dec. 10, 1973 Sweden ..... 7316617

[51] Int. Cl.[2] ..... D21C 7/06; D21C 7/12; D21C 7/14

[52] U.S. Cl. ..... 162/17; 162/19; 162/40; 162/49; 162/52; 162/237; 162/238; 162/246; 222/194; 222/17

[58] Field of Search ..... 162/52, 237, 246, 17, 162/19, 40, 41, 47, 57, 238, 239, 49; 214/17 CB, 17 CC; 222/194, 370; 73/23.1 (U.S. only); 137/624.18

[56] References Cited

U.S. PATENT DOCUMENTS

| | | | |
|---|---|---|---|
| 2,680,683 | 6/1954 | Obershain | 162/237 |
| 3,007,839 | 11/1961 | Richter | 162/17 |
| 3,429,773 | 2/1969 | Richter | 162/237 |
| 3,433,392 | 3/1969 | Roesig et al. | 222/194 |
| 3,441,475 | 4/1969 | Tomlinson | 162/237 |
| 3,537,953 | 11/1970 | Brown et al. | 162/52 |
| 3,585,002 | 6/1971 | Boys | 73/23.1 |
| 3,921,918 | 11/1975 | Peterson | 162/47 |

FOREIGN PATENT DOCUMENTS

| | | | |
|---|---|---|---|
| 165,680 | 12/1958 | Sweden | 162/52 |

*Primary Examiner*—S. Leon Bashore
*Assistant Examiner*—Steve Alvo
*Attorney, Agent, or Firm*—Cushman, Darby & Cushman

[57] ABSTRACT

A method and apparatus for filling a treatment vessel with a fiber material — liquid mixture. A conventional feeder rotor, having a number of pockets extending therethrough, has each pocket thereof sequentially filled with chips-liquid mixture in a first position from a pretreatment vessel. A portion of the liquid is withdrawn from the pocket, and the pocket rotates to a second position wherein the chips-liquid mixture in the pocket is discharged into a digester by a liquid flow. The pocket then rotates to a third position wherein the liquid in the pocket is discharged by admitting a gas, such as steam, under pressure into the pocket (and the pocket simultaneously filled with gas), and then to a fourth position wherein the gas is allowed to expand and be transported to a pretreatment vessel while the pocket is filled with cooking liquor, and thereby is ready to begin another cycle.

8 Claims, 2 Drawing Figures

METHOD AND APPARATUS FOR FILLING A PRESSURE TREATMENT VESSEL WITH A FIBER MATERIAL AND LIQUID MIXTURE

BACKGROUND OF THE INVENTION

The invention relates to a method and apparatus for filling of cellulose containing fiber material and liquid to steam phase in a preferably continuously working treatment vessel (a digester) at superatmospheric pressure for pulp production.

The main object of the invention is, in a simple way, to be able to feed into a treatment vessel and regulate the quantity of treatment liquid and fiber material so that the ratio between fiber material and liquid, (the wood/liquid ratio), will be as close as possible to the desired ratio for the process and cooking parameters which are desired.

Swedish Pat. No. 128,264 (see U.S. Pat. No. 2,680,683 also), which shows a feeding valve which mainly consists of a housing and a rotating rotor with pockets therein, which pockets are periodically filled and emptied, discloses conventional prior art apparatus. With such conventional apparatus it is possible with relatively good precision, to feed into a treatment vessel, a distinct quantity per unit of time of fiber material. With such conventional feed-in apparatus, the emptying of a rotor pocket takes place by turning the rotor so that the pocket communicates with an outer circulation pipe with ends connected to the digester and in which cooking liquor is being circulated. Thereby the fiber material is transported by the cooking liquor and is fed into the digester. When the pocket in such a device has emptied its content of fiber material, it is completely filled with cooking liquor of a volume which is greater than the volume of the cooking liquor which was present in the pocket just before it emptied its fiber material content. This means that the digester, when the feeder rotor is continuing to turn, has had a liquor volume corresponding to the volume of the fed-in fiber material tapped therefrom. In order to maintain the liquid balance of the digester, then, it is necessary by some accessory means to feed a quantity of liquid corresponding to the tapped-out quantity, into the digester as well as possible additional fresh treatment liquid. This often necessitates the utilization of high pressure pumps.

The present invention discloses a new method and an apparatus enabling the feeding of a digester with desired fiber material and a necessary predetermined desired quantity of treatment liquid. Herewith due regard is taken not only to the necessary quantity fresh treatment liquid for the digesting process but also to the quantity of moisture in the fiber materials and also the quantity of condensate from the pretreatment as well as leakage from the high pressure side of the feeder to its low pressure side.

DETAILED DESCRIPTION OF THE DRAWINGS

Figure 1:
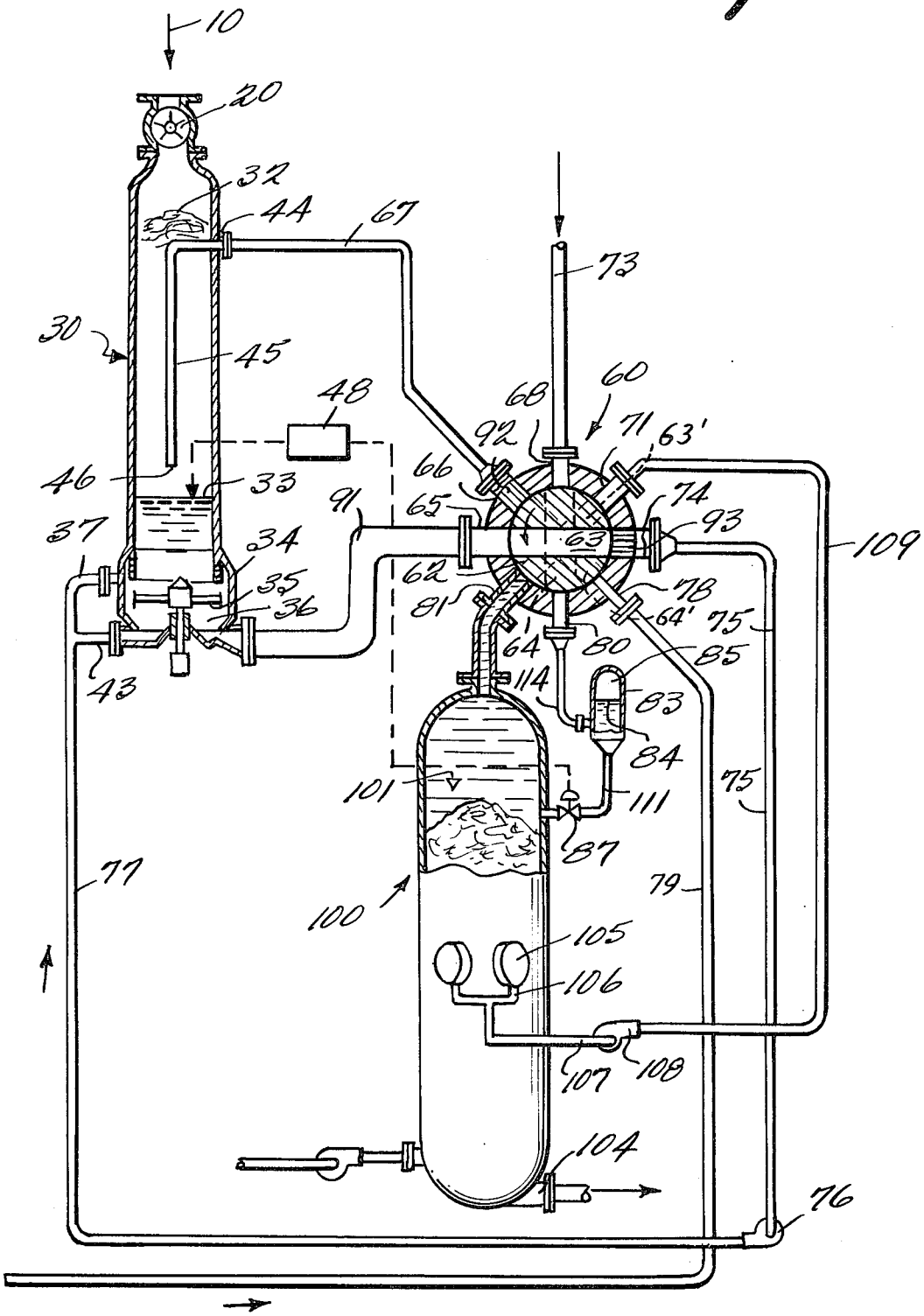
FIG. 1 shows schematically an exemplary digester feed-in system according to the present invention.

In FIG. 1 item 30 designates a pre-treatment vessel, 60 a conventional feed device of the cellfeeder type, and 100 a treatment vessel or digester. When the pre-treatment vessel 30 is working at atmospheric pressure, finely comminuted fiber material, for example wood chips 10, can be fed into vessel 30 by means of an open type charging device 20 or the like. When pre-impregnation vessel 30 is working at superatmospheric pressure or at vacuum the fiber material 10 can be fed into vessel 30 by means of a cellfeeder or the like which is closed against the prevailing super pressure. The vessel 30 may be a generally conical container with circular cross-section with a feed-out part 34 directly connected at the lower end thereof, in which a driven feed-out device 35 is rotatable. The device 35 may be a conventional "rotating table", which during its rotation feeds a certain quantity of fiber material downwardly to the chamber 36. The chamber 36 is part of a circulation circuit consisting of the pipe 91, feeder 60 through the connections 65 and 74, a pipe 75, a pump 76, and a pipe 77. The pipe 77 may be equipped with a branch 37 connected before chamber 36 for dilution over the table 35.

The feeder 60 consists mainly of a housing 61 with a generally conical hole, in which a rotor 62 rotates powered by a motor (not shown). The rotor is correspondingly conical and as housing and rotor wear, the rotor can be adjusted in an axial direction so that the sealing is maintained. The feeder rotor 62 is equipped with a number (i.e. four) of separate through-going pockets, such as 63, 63', 64, and 64'. When the feeder rotor 62 is rotating, the rotor pockets come one after the other into communication with openings distributed around the periphery of the housing 61, which openings may have normal pipe connections. Each such opening in the housing has a diametrically opposed opening which means that when one end of a rotor pocket is passing an opening, the other end of the pocket is simultaneously passing a diametrically opposed opening, which allows a flow through the feeder pocket. One or more of the openings in the feeder housing can be equipped with a screening device. In FIG. 1 two such screening devices are shown, 92 and 93.

The feeder housing illustrated in the drawings has eight openings in the periphery and thereby eight connection pieces, of which one — connection piece 68 — is connected to a high pressure steam line 73.

Part of the liquid contained in the chip-liquid-mixture which arrives at the feeder through line 91, is screened off by means of screen 93 and this liquid passes through connection piece 74 connected to line 75 in which a flow is maintained by means of the circulation pump 76 which is connected with a feeding-out part 34 in the pre-impregnation vessel 30 on its pressure side by line 77.

The feeder housing connection piece 80 is connected through line 114 to a container 83, in which a liquid level 84 is maintained with a steam chamber 85 or the like thereabove. On the outlet side of the container 83, the line 111 extends to one side of a regulating valve 87 which receives opening and closing impulses from the level indicator 48, which indicator 48 is responsive to liquid level 33. On the other side, the valve 87 is connected to the digester 100. A connection piece 68 — which is in a position diametrically opposed to the position of connection piece 80 — is connected to the high pressure steam line 73.

Opposite the connection piece 78, which is fed by fresh cooking liquor from the line 79, is disposed the connection piece 66 which preferably has an internal screen 92. The connection piece 66 is connected to line 67 for transporting expanding steam from the feeder pockets to the connection piece 44 and line 45 with an outlet 46 which may lie centrally in the pre-impregnation vessel 30 and above the liquid level 33 in the vessel 30.

A level 101 of fiber material is maintained in the liquid filled digester 100. The screens 105 are connected through lines 106 and 107 to a circulation pump 108, which through a line 109 is connected to the feeder connection 71. As the feeder rotor 62 turns, connection 71 is disposed in communication with an opposite connection 81 which is connected to the top of the digester. Conventional screens for discharge of liquid and conventional devices for the addition of cooking liquid or another liquid after cooling or heating may be disposed in the lower part of digester 100, as well as conventional apparatus for washing of the fiber material in the digester, and for addition of cooling liquid before the treated fiber material is discharged from digester 100 through connection piece 104.

The finely comminuted fiber material 10 is fed into the pre-impregnation vessel 30 by means of a charging device 20 and assumes a level 32 in the vessel 30, which is regulated by means of a gamma level regulator (not shown) or the like. In the vessel 30 liquid level 33 is maintained by means of a level indicator 48, which indicator 48 controls the valve 87. The pre-impregnation vessel 30 operates in such a way that substantially the same quantity of fiber material is fed-in through the charging device 20 as the quantity which is fed out through line 91 to the feeder 60. The constant liquid level 33 is maintained by maintaining the discharged liquid quantity equal to the incoming quantity. The incoming liquid quantity consists partly of (a) moisture following the fiber material, (b) condensate from the incoming steam or gases, which is fed-in from the feeder through line 67 to the pre-impregnation vessel at 46, as well as possibly by means of additional charge of steam to the pre-impregnation vessel through an accessory line (not shown) and (c) fresh cooking liquid fed-in through the line 79 which via the feeder 60 is fed into the system and through line 77 is transported into the lower part of the pre-impregnation vessel 30.

The liquid quantity discharged from the pre-impregnation vessel 30 consists of liquid which follows the fiber material through line 91 to the feeder connection 65, partly as liquid absorbed in, and partly as liquid around, the fiber material. A portion of this liquid quantity is discharged through the screen 93, said portion being returned to the pre-impregnation vessel through the line 75, the pump 76, and the line 77. During this discharge step, a feeder pocket is in connection with the connections 65 and 74. The feeder rotor rotates counter-clockwise. When the feeder pocket has turned to position 81, 71, the pocket content is flushed out of the pocket into the digester through connection 81 by liquid from the screens 105, lines 106, 107, pump 108, and line 109. During continued rotation of the pocket to vertical position 68, 80, the feeder pocket is still filled with circulation liquid from the pump 108. The rotor pocket in position 68, 80 is in communication with the high pressure steam line 73 which discharges all or part of the liquid quantity in the pocket through the connection 80 and line 114 to the container 83. The quantity of liquid is regulated by valve 87, which in turn maintains a constant level 33 in the pre-impregnation vessel via the level indicator 48. The remaining liquid quantity in a feeder pocket in position 68, 80 constitutes the surplus of cooking liquid which is not necessary for the process, and in the next position 66, 78 of the pocket it is transported by fresh treatment liquid from line 79 to the impregnation vessel 30. The net liquid quantity which in this way is fed into the digester is the only quantity which is discharged from the feed-in system since the other quantity of liquid which is discharged from the pre-impregnation vessel 30 is circulated back to the pre-impregnation vessel.

When a feeder pocket assumes position 81, 71, another pocket may simultaneously be in position 66, 78, and simultaneously a third pocket in position 65, 74, and a fourth pocket in position 68, 80, which means that a continuous ingoing and outgoing flow through the feeder takes place. The pockets can be spaced lengthwise in the feeder rotor and must not be able to communicate with each other.

After a pocket is emptied in position 68, 80, the pocket is partly or completely filled with gas or steam. During the continued rotation of the feeder pocket, the pocket thereafter assumes position 66, 78, whereby the steam in the pocket expands and the pressure is reduced to the prevailing pressure in the feeding-in system due to the fact that the pocket is in communication with the line 67 which leads to the impregnation vessel 30. In position 66, 78 an after-filling of the pocket with cooking liquor through line 79 takes place so that the pocket is filled with cooking liquor when it turns to position 65, 74, in which position the feeder rotor has rotated half a revolution and a cycle is completed.

Figure 2:
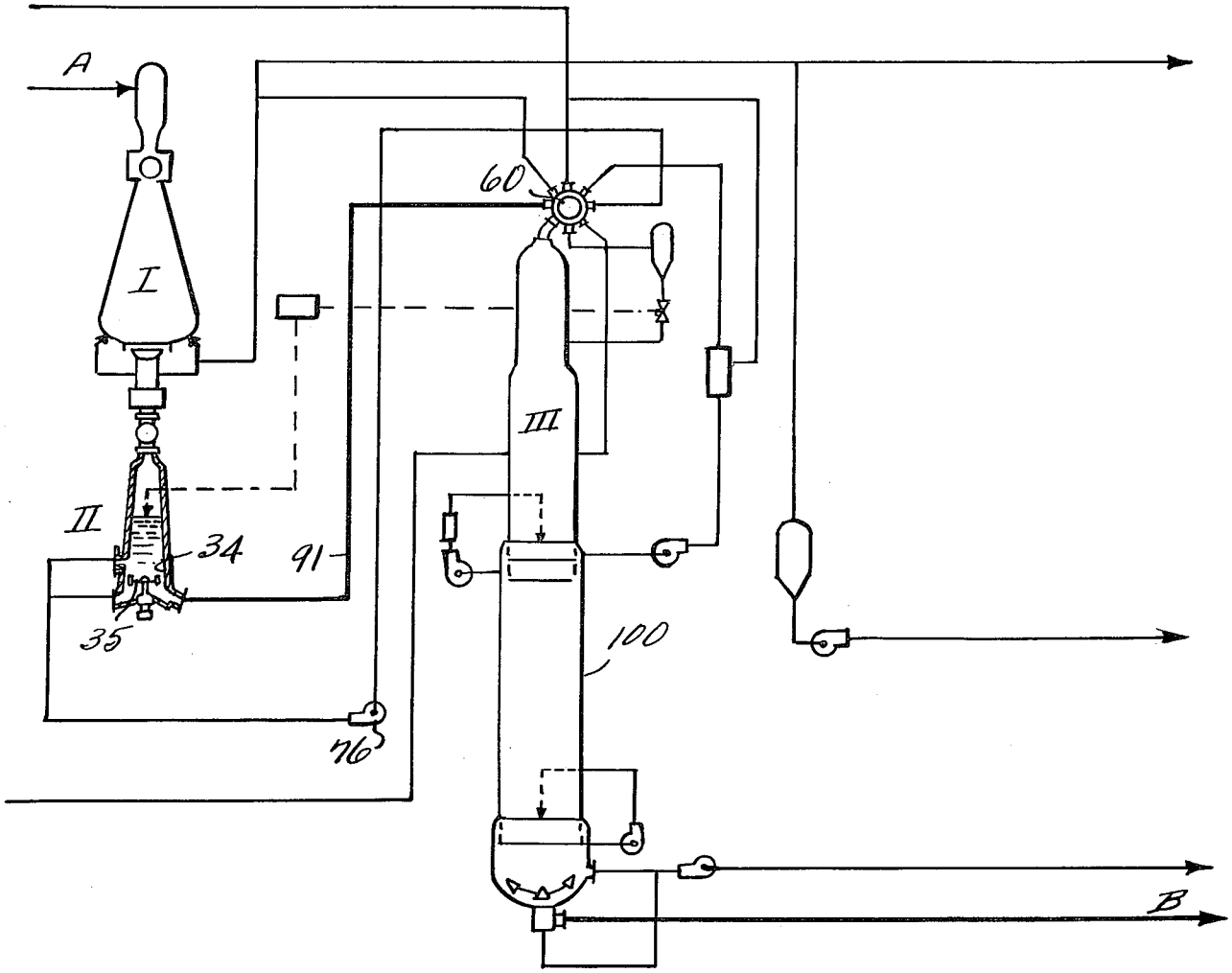
FIG. 2 shows a flow sheet for an exemplary installation according to the present invention.

FIG. 2 shows as an example a simplified flowsheet where the present invention is incorporated. The flowsheet consists of I) vessel for atmospheric steaming in which the finely comminuted fiber material enters into the system, II) vessel for low pressure impregnation, and III) liquid filled digester. The fiber material is fed in at A. The feeder 60 has in this case been placed at the top of the digester 100 and the pre-treatment vessel has been placed at a low level as compared to the feeder. The inlet liquid flow to the feeding-out part 34 is taking the fiber material fed down by the table out in the line 91 to the feeder 60. The digester itself 100 can be conventional with built-in washing in the digester lower part. The washed fiber material is finally blown out from the container in a known manner at B.

While the invention has been herein shown and described in what is presently conceived to be the most practical and preferred embodiment, it will be apparent that many modifications may be made thereof. For instance, the digester need not be completely filled with liquid, the feeder may be placed at a level lower than the digester top and the rotor pocket contents pumped to the digester top, and steam may be disposed in the top portion of the digester if surplus liquid is separated from the chips-liquid mixture entering from the feeder. Many other modifications are also possible, therefore it is intended that the present invention be accorded the broadest scope of the appended claims so as to encompass all equivalent methods and devices.

What is claimed is:

1. A method of filling a pressure treatment vessel operatively connected to a pretreatment vessel with a chips-liquid mixture utilizing apparatus having four non-communicating pockets of predetermined dimension, each pocket extending completely therethrough for simultaneous communication with an inlet and outlet thereto, said method comprising the steps of continuously establishing a flow of a chips-liquid mixture from the pretreatment vessel along a first path into a liquid filled pocket, depositing a chips-liquid mixture of a given volume in the pocket while displacing liquid already in the pocket and removing it therefrom, discharging the chips-liquid mixture in the pocket into the treatment vessel by displacing the chips-liquid mixture from the pocket with liquid under pressure from the treatment vessel, and thereby filling the pocket with said liquid, displacing at least a portion of the liquid in the pocket from the pocket by admitting gas under pressure into the pocket; said depositing, discharging, displacing, and discharging steps are accomplished by rotating said rotor past four sets of cooperating inlets and outlets, communication between one set of inlets and outlets and a pocket taking place at all times, transferring the liquid displaced from the pocket by gas to the treatment vessel, discharging the gas from the pocket into the pretreatment vessel and simultaneously filling the pocket with liquid so that the pocket is filled with liquid when another chips-liquid mixture is admitted thereto, and continuously repeating all the above steps.

2. A method as recited in claim 1 wherein the quantity of liquid displaced by admitting gas under pressure to the liquid-filled pocket is dependent upon the level of liquid in the pretreatment vessel.

3. A method as recited in claim 1 wherein said step of depositing a chips-liquid mixture of a given volume in the pocket while displacing liquid already in the pocket and removing it therefrom is accomplished by screening the pocket contents.

4. A method as recited in claim 1 wherein said step of transferring the liquid displaced from the pocket by gas to the treatment vessel is accomplished by feeding the liquid to an area above a fiber material column maintained in the treatment vessel.

5. A method as recited in claim 4 comprising the further step of metering the liquid from the area above the fiber material column to the treatment vessel by a valve.

6. A method as recited in claim 1 wherein the gas admitted under pressure into the pocket is steam.

7. Apparatus for filling a pressure treatment vessel operatively connected to a pretreatment vessel with a chips-liquid mixture, said apparatus comprising a rotary valve member having four non-communicating pockets extending therethrough, each extending in a direction perpendicular to the axis of rotation of said valve member for providing communication between an inlet and an outlet, means for depositing a chips-liquid mixture of a given volume into each pocket while displacing liquid already in the pocket and removing it therefrom at a first position of said valve member, said means comprising a first inlet and a first outlet means for discharging the chips-liquid mixture in each pocket into the pressure treatment vessel by displacing the chips-liquid mixture from the pocket with liquid under pressure from the treatment vessel, and thereby filling the pocket with said liquid, at a second position of said valve member, said means including a second inlet and a second outlet means for displacing at least a portion of the liquid in each pocket from the pocket by admitting gas under pressure into the pocket at a third position of said valve member, said means including a third inlet and a third outlet means for transferring the liquid displaced from each pocket by gas to the treatment vessel, means for discharging the gas or steam from each pocket into the pretreatment vessel at a fourth position of said valve member and simultaneously filling the pocket with liquid so that the pocket is filled with liquid when another chips-liquid mixture is admitted thereto, said means including a fourth inlet and a fourth outlet, a pocket being in communication with each of said first, second, third, and fourth inlets and outlets at all times so that all steps performed by said apparatus are continuous, and means for continuously sequentially rotating said valve member about an axis of rotation from said first to said second to said third to said fourth and back to said first position.

8. Apparatus as recited in claim 7 wherein said means for transferring the liquid displaced from the pocket by gas includes means at said third position of said valve member for transporting the displaced liquid. to a separate container above a fiber material column maintained in the treatment vessel, and a valve controlled by the liquid level in the pretreatment vessel for metering the liquid from the container to the treatment vessel.

* * * * *